US008284969B2

(12) United States Patent
Heerlein et al.

(10) Patent No.: US 8,284,969 B2
(45) Date of Patent: Oct. 9, 2012

(54) HEARING AID HAVING AN OPERATING DEVICE

(75) Inventors: Markus Heerlein, Singapore (SG); Harald Klemenz, Singapore (SG); Beng Hai Tan, Singapore (SG); Kim Ho Patrick Yau, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 953 days.

(21) Appl. No.: 12/275,505

(22) Filed: Nov. 21, 2008

(65) Prior Publication Data

US 2009/0129618 A1 May 21, 2009

(30) Foreign Application Priority Data

Nov. 21, 2007 (DE) ..... 10 2007 055 672

(51) Int. Cl.
*H04R 25/00* (2006.01)

(52) U.S. Cl. ..... 381/314; 381/323; 381/329

(58) Field of Classification Search ..... 381/314, 381/323, 328, 329

See application file for complete search history.

(56) References Cited

U.S. PATENT DOCUMENTS 6,919,519 B2 * 7/2005 Ravnkilde et al. ..... 200/52 R
2006/0171550 A1 * 8/2006 Bryant et al. ..... 381/330

* cited by examiner

*Primary Examiner* — Matthew E Warren
(74) *Attorney, Agent, or Firm* — Laurence A. Greenberg; Werner H. Stemer; Ralph E. Locher

(57) ABSTRACT

A hearing aid has an operating device with an operating element for activating a first operating function and a second operating function of the hearing aid. The operating device is configured to cause an execution of an operating function of the hearing aid by activating the corresponding operating function via the operating element. The operating device suppresses the execution of the first operating function by activating the first operating function via the operating element if the second operating function is activated via the operating element.

19 Claims, 2 Drawing Sheets

HEARING AID HAVING AN OPERATING DEVICE

CROSS-REFERENCE TO RELATED APPLICATION

This application claims the priority, under 35 U.S.C. §119, of German application DE 10 2007 055 672.3, filed Nov. 21, 2007; the prior application is herewith incorporated by reference in its entirety.

BACKGROUND OF THE INVENTION

Field of the Invention

The invention relates to a hearing aid with an operating device. An operating element of the operating device makes it possible to activate a first and a second operating function of the hearing aid. Provision is made in this case to suppress the execution of the first operating function if the second operating function is activated via the operating element. The invention also relates to a corresponding method for operating a hearing aid.

Modern hearing aids have a multiplicity of different setting options, for example ones for electrical or acoustic parameters. While specific parameters of a hearing aid are set by an acoustic technician during a programming session, for example, other settings can also be undertaken independently by the hearing aid wearer during the operation of the hearing aid. The last mentioned settings include, for example, setting the volume, changing between different hearing program and/or operating modes, or switching the hearing aid on and/or off. Such settings are generally carried out via operating elements that are typically arranged on the outside of the aid in a readily accessible fashion. Different degrees of freedom of the operating element can be employed in the case of such operating elements. Thus, given an appropriately designed operating element, aside from simply actuating a pressure or touch switch it is also possible, for example, to make use of the most varied rotary/toggle/rocking or displacement movements in order to activate the functions of the aid.

Because of the relatively small size of modern hearing aids, the accommodation of a number of such operating elements in conjunction with good accessibility and operability proves to be problematic. This applies principally to the so-called ITE (in-the-ear) aids. These hearing aids have particularly pronounced miniaturization in order to be capable of being arranged entirely inside the auditory canal. For this reason, they also have only a relatively small front face that is available for the accommodation of the operating elements.

It is already known for a number of operating functions and/or setting options to be actuated via a common operating element in the case of hearing aids. Such operating elements then comprise, for example, two different input devices such as, for example, a mechanical pressure or touch switch and a rotary switch. It is also possible for other combinations of input devices to be implemented in an operating element, for example a pressure switch and a toggle or rocker switch, or a pressure switch or touch switch and a slide switch.

Furthermore, operating functions can be unambiguously recognized from the duration of the manual input, and thereby be distinguished from one another. Thus, in the case of a touch switch, for example, different operating functions can be distinguished from one another by how long the touch switch is manually actuated.

Owing to the use of such multifunctional operating elements, an inadvertent activation of another operating function can come about upon actuating the operating element for the manual input of a specific operating function. For example, during the attempt to set the volume control (VC) of a hearing aid by rotating a combined pressure and rotary switch the pressure switch can be inadvertently operated, thus causing a change of program. Precisely in the case of relatively small operating elements such as are used, for example, in the case of the above described ITE hearing aids, such operating errors caused by inadvertent execution of an operating function can occur relatively frequently, and thereby be perceived as very annoying.

SUMMARY OF THE INVENTION

It is accordingly an object of the invention to provide a hearing aid with a control device which overcomes the above-mentioned disadvantages of the heretofore-known devices and methods of this general type and which provided for a hearing aid in the case of which the inadvertent execution of an operating function via a multifunctional operating element is avoided.

With the foregoing and other objects in view there is provided, in accordance with the invention, a hearing aid, comprising:

an operating device with an operating element for activating a first operating function and a second operating function of the hearing aid;

said operating device being configured to execute a respective operating function by activating a corresponding operating function via said operating element; and said operating device being configured to suppress an execution of the first operating function upon activation of the first operating function via said operating element if the second operating function is also activated via the operating element.

With the above and other objects in view there is also provided, in accordance with the invention, a method for operating a hearing aid. The method comprises the following steps:

providing a hearing aid with a first operating function and a second operating function, and selectively activating the first and second operating functions of the hearing aid via a common operating element; and suppressing an execution of the first operating function upon an activation of the first operating function via the common operating element if the second operating function is also activated via the common operating element.

In other words, a hearing aid according to the invention has an operating device that comprises an operating element for activating a first and a second operating function of the hearing aid. The operating device is designed to execute an operating function of the hearing aid via, or as a result of, activating the corresponding operating function via the operating element. Furthermore, the operating device is designed to suppress the execution of the first operating function by, or as a result of, activating the first operating function via the operating element if the second operating function is also activated via the operating element. The activation of the first operating function via the operating element therefore does not lead directly to an execution of this operating function in the hearing aid. Rather, the execution of the first operating function is controlled depending on whether the second operating function has also been activated via the common operating element. It is advantageously possible thereby to effectively avoid inadvertently executing the first operating function in the case of an intended activation of the second operating function.

In an advantageous embodiment of the invention, it is provided that the operating device suppresses a first activation signal, which is generated upon activation of the first operating function, if the second operating function is activated via the operating element. The activation of the first operating function is reset by the suppression of the first activation signal. The execution of this operating function can thereby be effectively suppressed.

A further advantageous embodiment of the invention provides a control device with a logic circuit, the first activation signal generated by the activation of the first operating function serving the logic circuit as input variable, and a second activation signal generated by the activation of the second operating function serving the logic circuit as input variable. It is provided that given the presence of an activation signal, the logic circuit executes the corresponding operating function, the logic circuit resetting the first activation signal if the second activation signal is also present at its input. The logic circuit can be used to implement the control of the operating functions particularly easily. A logic circuit designed as an electronic circuit can be implemented particularly easily and cost-effectively by logic gates.

In accordance with a further advantageous embodiment of the invention, a mechanical control device is provided in which the execution of the first operating function can be blocked by the activation of the second operating function. A reliable and current-saving operating device can be implemented by the use of such a mechanical solution.

In one embodiment of the invention, the operating element comprises a pressure or touch switch, the activation of the first operating function being performed by actuating this switch. It is advantageous in this case when the first operating function is activated only upon release of the touch switch. It is thereby possible to use the time between the inadvertent pressing and the release of the touch switch to check whether the second operating function has also been activated. If this is the case, the first operating function is not executed. Inadvertent control operations can already be effectively avoided with the aid of this simple method.

Furthermore, it is provided in a further advantageous embodiment of the invention that the activation of the second operating function is performed by actuating an operating element comprising a rotary or toggle switch. Multifunctional operating elements can be implemented in a particularly small space precisely by the combination of such a switch with a touch switch.

Finally, a further advantageous embodiment of the invention provides that the operating device executes the first operating function only with a delay after the activation of the first operating function via the operating element. This delay allows those activations of the second operating function that have been performed only after the activation of the first operating function to be detected via the operating element.

Other features which are considered as characteristic for the invention are set forth in the appended claims.

Although the invention is illustrated and described herein as embodied in hearing aid having an operating device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
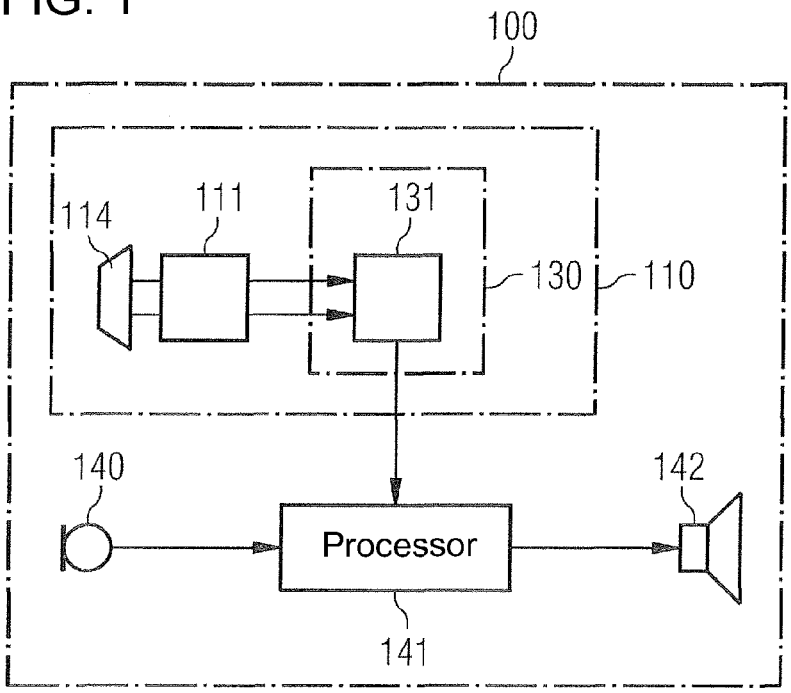
FIG. 1 is a schematic of a hearing aid having an operating device that comprises an operating element.

Referring now to the figures of the drawing in detail and first, particularly, to FIG. 1 thereof, a hearing aid 100 may, for example, be designed as an ITE hearing aid. An electrical signal made available by an input microphone 140 is typically processed in such a hearing aid by way of a signal processing device 141 in accordance with a setpoint. With the aid of the output signal of the signal processing device 141, an output stage is used to drive an output transducer 142 that produces a corresponding sound signal in the auditory canal of the hearing aid wearer. The components 140, 141, 142 of the signal processing path are illustrated only by way of example in FIG. 1. For reasons of clarity, not all components are illustrated.

A typical hearing aid 100 has various setting options that relate, for example, to the signal processing or the operation of the aid as such. Depending on the application, specific parameters can already be preset during manufacture or in a subsequent configuration. Other settings, such as the selection of the operating mode, for example, can also be undertaken independently by the hearing aid wearer. To this end, the various setting options are implemented in the hearing aid 100 as operating functions that are invoked via an operating device 110 of the hearing aid 100. The operating device 110 in this case has at least one operating element 111 that can be accessed by the hearing aid wearer and via which an operating function can be selected and/or activated. In the present case, the operating element 111 is designed as a multifunctional operating element via which at least two different operating functions can be activated independently of one another.

In this case, the operating element 111 can be designed as a mechanical operating element. Such an operating element must generally be actuated mechanically in a way prescribed by its design, in order to activate a specific operating function. In order to be able to use the operating element to determine the input or activation of an operating function unambiguously, the various operating functions of the respective operating element are generally assigned different movement sequences. Thus, in a hearing aid the two operating functions of volume control (VC) and program change (push-button, PB) can frequently be activated via a common operating element 111. It is possible to select the change of programs or operating modes, for example, via a pressure or touch switch, and to select the volume control via a rotary switch. The switches are united in the common operating element 111.

It is likewise possible also to use other switch combinations such as, for example, a touch or pressure switch and a toggle, rocker or slide switch. Moreover, such multifunctional operating elements can also have non-mechanical input devices in the case of which the activation of the respective operating function is performed, for example, merely by touching a correspondingly sensitive surface or by approaching such a surface.

As FIG. 1 shows, the operating element 111 is part of the operating device 110 of the hearing aid 100. The operating device 110 also comprises a control device 130. The control device 130 controls the execution of the operating functions, which are activated via the common operating element 111. To this end, the control device 130 can comprise a logic circuit 131, as is the case here. The logic circuit 131 can detect the activation states of the respective operating functions be means, for example, of activation signals $S_{PB}$, $S_{VC}$ that are generated upon the activation of the respective function PB, VC. The activation signals $S_{PB}$, $S_{VC}$ are received by the logic circuit 131 via appropriate signal lines from the operating element 110. Depending on which functions PB, VC of the aid are activated, the logic circuit 131 or the control device 130 uses an appropriate control signal to control the execution of the respective operating function PB, VC. To this end, the logic circuit 131 can output the control signal to that component in which the appropriate operating function is being executed. To this end, in FIG. 1 the logic circuit 131 is connected to the signal processing device 141 via a signal line.

Both the logic circuit 131 and the control device 130 can be designed as integrated circuits. In such a case, the logic circuit 131 or the entire control device 130 can be accommodated jointly on a chip with the signal processing device 141 or with parts thereof.

Although the control device 130 shown here is preferably implemented electronically, it is also possible in principle for the control of the operating functions PB, VC that can be activated via the operating element 111 to be implemented mechanically. In such a case, the connecting arrows between the components 111, 131, 141 would represent mechanical operative connections. The execution of the first operating function PB could then be suppressed by mechanically blocking the appropriate operative connection.

The aim below is to describe in more detail a specific operating element 111 that is particularly well suited for use in an ITE hearing aid because of its low space requirement.

Figure 2:
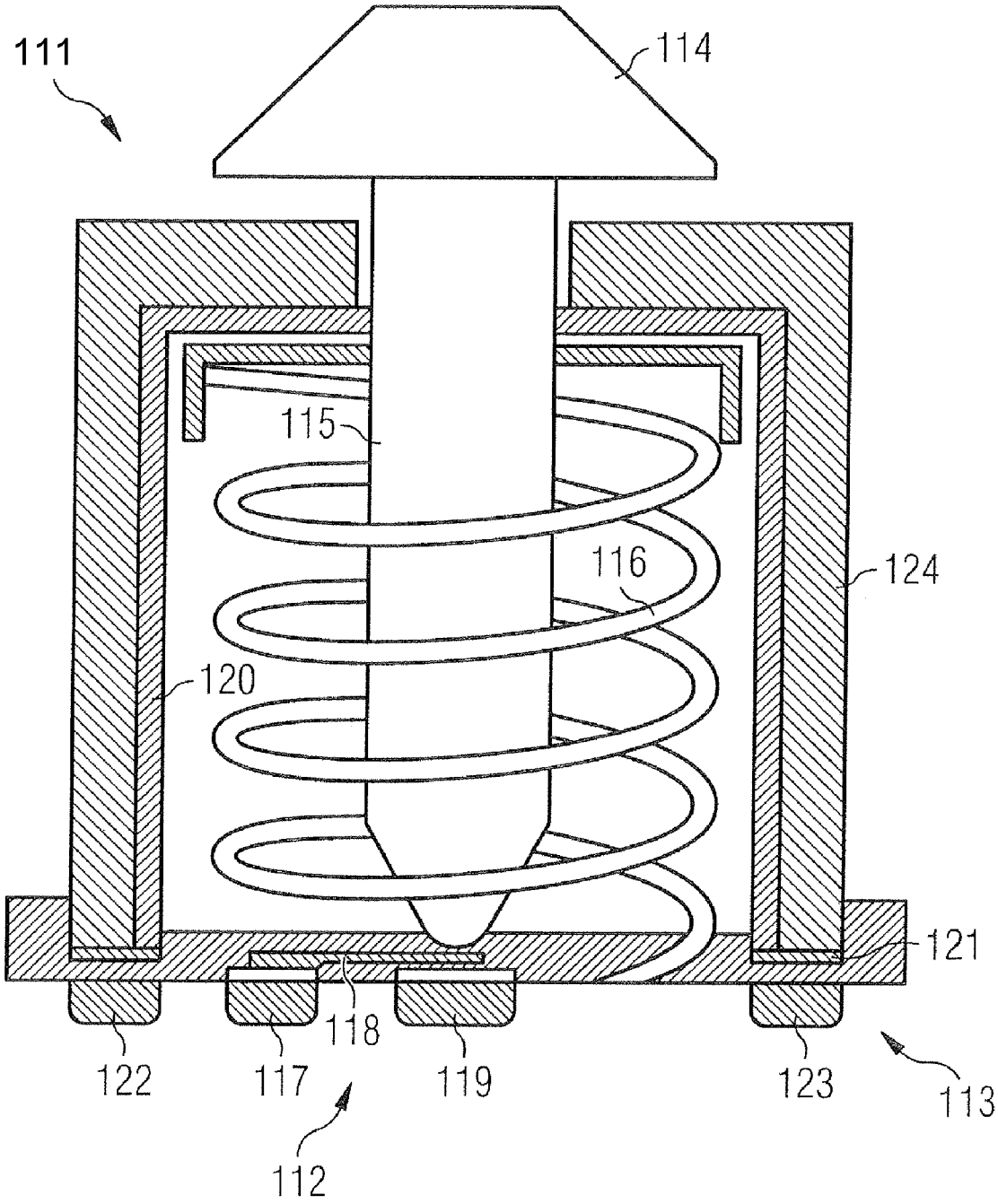
FIG. 2 is a partly sectional view showing a mechanically actuatable operating element comprising a pressure switch and a rotary switch for activating different operating functions of the hearing aid.

FIG. 2 shows by way of example such a multifunctional operating element 111 in a cross-sectional illustration. The operating element 111 in this case comprises a touch switch 112 and a rotary switch 113. Both switches 112, 113 are actuated by way of a common actuating knob 114.

In the present example, the touch switch 112 substantially comprises a first and a second contact element 117, 119, a contact cantilever 118 connected to the first contact element 117 being arranged in a sprung fashion over the second contact element 119. The touch switch 112 is closed in this case by pressing the actuating knob 114 downward against the spring force of the spring element 116. With its tip, an operating pin 115 connected to the actuating knob 114 then presses the contact cantilever 118 against the second contact 119 in such a way that an electric circuit is closed via the touch switch 112. Upon release of the actuating knob 114, the latter is raised upward by the spring element 116 such that the contact cantilever 118 again swings upward. The switching contact is thereby interrupted, and the touch switch 112 is reopened. It will be understood that it is also possible in principle to reverse the switching behavior, with the switching contact being opened upon the depression of the actuating knob 114 and closed upon the release of the actuating knob 114.

It is provided according to the invention that the push-button function PB of the hearing aid 100 is activated only upon the release of the actuating knob 114. The corresponding activation signal $S_{PB}$ is therefore generated in the present example in the negative pulse, that is to say only upon the opening of the touch switch 112.

The second operating function of the hearing aid 100, here the volume control setting VC, is activated in the present case with the aid of the rotary switch 113 of the operating element 111. To this end, the rotary switch 113 has one or more contact areas 121 arranged in a rotationally symmetrical fashion around the operating pin 115. A sleeve-shaped element 120 that is arranged inside a sleeve-shaped housing 124 of the actuating element 110 serves as rotor in this case. The rotor 120 is also rotated by the operating pin 115 in this case. The rotary switch achieves various switching states depending on rotary position. The current switching state can be determined in this case by measuring current or voltage via appropriate contacts 122, 123, for example. It determines the current volume setting of the hearing aid 100.

In order to prevent the execution of the first operating function PB (change of the operating mode or program) as early as upon an inadvertent depression of the actuating knob 114, before the actually intended rotation of the actuating knob 114 and the activation, associated therewith, of the second operating function VC have been detected, the first operating function PB is preferably not executed directly by the activation of this operating function via the operating element 111. Rather, a specific delay is provided between the activation and the execution of the first operating function PB. If the hearing aid 100 or its control device 130 detects in this time that the second operating function VC has also been activated by an appropriate actuation of the operating element 111, the execution of the first operating function PB is suppressed. This can be performed by blocking the mechanical or electrical operative connection between the part of the operating device 110 that is responsible for activating the first operating function PB, and the part that is responsible for executing it. Moreover, the activation of the second operating function VC can also be used to suppress the first activation signal $S_{PB}$ or, more generally, to reset the activation state of the first operating function PB. Only the second operating function VC, which continues to be activated, is executed in this case as well.

A delay in the case of the operating element shown in FIG. 2 can be achieved, for example, by virtue of the fact that the first operating function PB is not, as otherwise usual, activated upon depression of the touch switch 112, but only in the negative pulse, that is to say only upon release of the touch switch 112. This can be achieved relatively easily by appropriate electronics that triggers only on the signal edge generated upon release of the touch switch. Since the time between the depression and the release of the touch switch 112 depends strongly on the individual operating behavior of the user, it is also possible to provide additional measures in order to obtain a delay time required for reliable detection of the intended operation. It is possible, inter alia, to design the operating device 110 such that the first operating function PB is not executed directly after the activation, already delayed by the triggering to the negative pulse, of the corresponding operating function PB, but only after expiry of a preferably prescribable time after release of the touch switch 112.

It is possible in principle in this case, as well, to implement yet a further, defined delay between the activation and the execution of the first operating function PB electronically.

The switching behavior of a logic circuit 131 that controls the execution of the operating functions PB, VC is explained below with the aid of a table. Such a logic circuit can, for example, be implemented in the operating device 110 illustrated in FIG. 2. Here, the first column of the table indicates the activation state of the first operating function (here, program change PB), which is activated by pressing or releasing the touch switch. By contrast, the second column illustrates the activation state of the second operating function (here, volume control VC), which is activated by rotating the actuating knob 114 of the operating element 111. In both columns, the activated state of an operating function is illustrated by a plus (+), and the inactive or deactivated state of the corresponding operating function is illustrated by a minus (−). In the case that an appropriate activation signal $S_{PB}$, $S_{VC}$ is generated by the activation of an operating function PB, VC, the plus (+) and the minus (−) in the table illustrate the occurrence or the nonoccurrence of the respective activation signal at the corresponding input of the logic circuit 131.

Finally, the third column shows which control function outputs the logic circuit 131 as response to the activation signals present at its input. In this case, the control function determines which of the two operating functions VC or PB is actually executed or whether it is intended to execute any operating function at all.

| PB Function | VC Function | Control Function |
|---|---|---|
| − | − | − |
| + | − | PB |
| − | + | VC |
| + | + | VC |

It can be seen from the table that as long as there is no activation signal present at an input of the logic circuit 131 none of the two operating functions PB, VC is executed either. The activation of the program change function PB without a corresponding activation of the volume control VC leads to the execution of the program change function PB in the hearing aid 100. The activation of the volume control VC without a corresponding activation of the program change function PB likewise leads to the execution of the volume control VC in the hearing aid 100. If, however, both operating functions PB and VC are activated simultaneously or shortly after one another owing to an operating error, for example, the logic circuit 131 outputs only the control signal for executing the second operating function (volume control VC). The execution of the first operating function (program change PB) is suppressed in this case. The activation signal $S_{PB}$ of the first operating function PB, which is present at the input of the logic circuit 131, can also in this case be reset or suppressed, specifically directly by activating the second operating function VC, or by the control device 130 after detection of the second activation signal $S_{VC}$.

Figure 3:
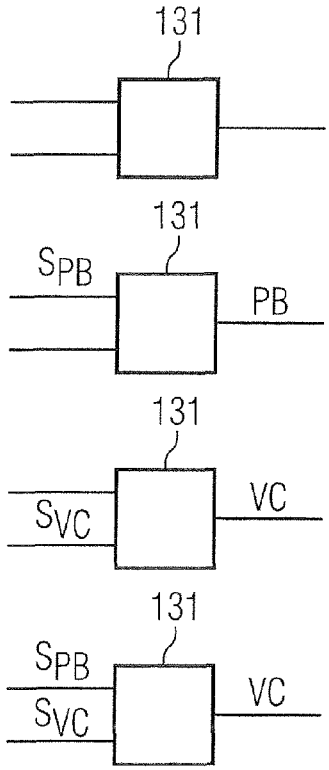
FIG. 3 is a schematic of the switching operations of a control device of the operating device.

The four different switching states of the logic circuit 131 are now to be explained with the aid of FIG. 3. In this connection, no activation signal $S_{PB}$, $S_{VC}$ is present at either of the two inputs of the logic circuit 131 in the first case. Consequently, there is also no signal for executing an operating function PB, VC present at the output of the logic circuit 131. In the second case, a signal is present only at the first of the two inputs of the logic circuit 131, this being the first activation signal $S_{PB}$. As a result, the logic circuit 131 outputs a control signal for executing the first operating function PB to its output. This signal causes the hearing aid or the signal processing device 141 of the hearing aid 100 to undertake a change of the hearing program or of the operating mode. Likewise, in the case when only the second activation signal $S_{VC}$ is present at the corresponding input of the logic circuit 131 it is also only this operating function VC that is executed.

If, however, both operating functions PB, VC are activated simultaneously, so that the two activation signals $S_{PB}$, $S_{VC}$ are simultaneously present on the logic circuit 131, the logic circuit 131 outputs only the signal for executing the second operating function VC. The execution of the first operating function PB is suppressed in accordance with the invention, in this case. The same holds true when the two operating functions PB, VC are activated shortly after one another via the operating element 111. These two cases are shown by the two lower illustrations of FIG. 3.

The invention is not restricted to the exemplary embodiments illustrated in the figures and in the above description. Rather, the invention extends to any desired operating elements and operating functions of a hearing aid. Thus, for example, it is also possible to provide more than two operating functions for an operating element in which the execution of one or more operating functions is suppressed by the activation of a priority operating function.

It is irrelevant for the invention whether the operating device 110 or the control device 130 or its logic circuit 131 executes an operating function PB, VC directly, or whether it merely prompts the execution of the corresponding operating function PB, VC, for example by outputting a corresponding signal.

The invention claimed is:

1. A hearing aid, comprising:

an operating device with an operating element for activating a first operating function and a second operating function of the hearing aid;

said operating device being configured to execute a respective operating function by activating a corresponding operating function via said operating element; and said operating device being configured to suppress an execution of the first operating function if the first operating function and the second operating function are activated substantially simultaneously via said operating element.

2. The hearing aid according to claim 1, wherein said operating device is configured:

to generate a first activation signal upon activation of the first operating function; and to suppress the first activation signal if the second operating function is activated via the operating element.

3. The hearing aid according to claim 2, which comprises:

a control device with a logic circuit having an input connected to receive a first activation signal generated by the activation of the first operating function and a second activation signal generated by the activation of the second operating function;

wherein the first activation signal serves as a first input variable of the logic circuit and the second activation signal serves as a second input variable of the logic circuit;

wherein said logic circuit is configured to execute a corresponding operating function given a presence of a respective activation signal; and wherein said logic circuit is configured to reset the first activation signal if the second activation signal is also present at the input.

4. The hearing aid according to claim 3, wherein said logic circuit is an electronic circuit.

5. The hearing aid according to claim 1, which comprises a mechanical control device configured to selectively block the execution of the first operating function by the activation of the second operating function.

6. The hearing aid according to claim 1, wherein said operating element comprises a pressure or touch switch, and the activation of the first operating function is performed by actuating the switch.

7. The hearing aid according to claim 6, wherein said operating device is configured to activate the first operating function only upon release of said touch switch.

8. The hearing aid according to claim 1, wherein said operating element comprises a rotary or toggle switch, and the activation of the second operating function is performed by actuating the switch.

9. The hearing aid according to claim 1, wherein said operating element comprises a touch-sensitive or non-contact input device, and at least one of the first and second operating functions may be activated via said input device.

10. The hearing aid according to claim 1, wherein said operating device is configured to execute the first operating function only with a time delay after the activation of the first operating function via said operating element.

11. The hearing aid according to claim 1, configured as an in-the-ear hearing air device.

12. A method for operating a hearing aid, which comprises:

providing a hearing aid with a first operating function and a second operating function, and selectively activating the first and second operating functions of the hearing aid via a common operating element; and suppressing an execution of the first operating function if the first operating function and the second operating function are activated substantially simultaneously via the common operating element.

13. The method according to claim 12, which comprises:

generating a first activation signal in response to an activation of the first operating function; and suppressing the first activation signal if the second operating function is also activated via the operating element.

14. The method according to claim 13, which comprises:

generating a second activation signal in response to an activation of the second operating function;

executing one of the first and second operating functions with the aid of a logic circuit if an activation signal of the corresponding operating function is present at an input of the logic circuit and resetting the first activation signal by the logic circuit if the second activation signal is also present at the input of the logic circuit.

15. The method according to claim 12, which comprises mechanically blocking the execution of the first operating function upon activation of the second operating function.

16. The method according to claim 12, which comprises activating the first operating function by actuation of a pressure or touch switch of the operating element.

17. The method according to claim 16, which comprises activating the first operating function only upon release of the touch switch.

18. The method according to claim 12, which comprises activating the second operating function by actuating a rotary or toggle switch of the operating element.

19. The according to claim 12, which comprises executing the first operating function with a time delay after an activation of the first operating function via the operating element.

* * * * *